US007650006B2

(12) United States Patent
Isotalo

(10) Patent No.: US 7,650,006 B2
(45) Date of Patent: Jan. 19, 2010

(54) METHOD TO GENERATE A PLANE ACOUSTIC WAVE FRONT, A PLANE WAVE CHANNEL, A LOUDSPEAKER CONSTRUCTION AND A LINEAR LOUDSPEAKER ARRAY

(75) Inventor: Mika Isotalo, Aura kk (FI)

(73) Assignee: Aura Audio Oy, Lieto (FI)

( * ) Notice: Subject to any disclaimer, the term of this patent is extended or adjusted under 35 U.S.C. 154(b) by 866 days.

(21) Appl. No.: 11/117,737

(22) Filed: Apr. 29, 2005

(65) Prior Publication Data

US 2005/0265570 A1 Dec. 1, 2005

(30) Foreign Application Priority Data

Apr. 30, 2004 (FI) ..... 20040623

(51) Int. Cl.
*H04R 1/20* (2006.01)

(52) U.S. Cl. ..... 381/340; 381/337; 381/342; 381/343; 381/152; 381/351; 181/144; 181/145; 181/142; 181/159; 181/193

(58) Field of Classification Search ..... 381/304–305, 381/337, 339–343, 338, 345, 335–336, 351, 381/386; 181/175–177, 185–197, 152, 199, 181/144, 159, 160, 142, 145
See application file for complete search history.

(56) References Cited

U.S. PATENT DOCUMENTS

| | | | | |
|---|---|---|---|---|
| 4,181,193 A | | 1/1980 | Isaac | 181/185 |
| 4,267,405 A | | 5/1981 | Russell | 179/1 E |
| 4,325,456 A | | 4/1982 | Ureda | 181/159 |
| 4,776,428 A | | 10/1988 | Belisle | 181/185 |
| 5,117,462 A | * | 5/1992 | Bie | 381/343 |
| 6,026,928 A | * | 2/2000 | Maharaj | 181/152 |
| 6,064,745 A | | 5/2000 | Avera | 381/343 |
| 6,094,495 A | | 7/2000 | Rocha | 381/340 |
| 6,343,133 B1 | * | 1/2002 | Adamson | 381/340 |
| 6,628,796 B2 | * | 9/2003 | Adamson | 381/342 |
| 6,744,899 B1 | | 6/2004 | Grunberg | 381/343 |
| 7,177,437 B1 | * | 2/2007 | Adams | 381/340 |
| 2004/0151325 A1 | | 8/2004 | Hooley et al. | 381/18 |

FOREIGN PATENT DOCUMENTS

| | | |
|---|---|---|
| DE | 103 10 1033 A1 | 9/2004 |
| EP | 1 315 398 A2 | 5/2003 |
| WO | 02/25991 A1 | 3/2002 |

* cited by examiner

*Primary Examiner*—Vivian Chin
*Assistant Examiner*—Disler Paul
(74) *Attorney, Agent, or Firm*—Kubovcik & Kubovcik

(57) ABSTRACT

A method and a loudspeaker construction (10), in which loudspeaker construction spherical acoustic wave fronts emitted by the diaphragms (12) of speaker elements (11) are transformed into a uniform, planar acoustic wave front. The loudspeaker construction (10) comprises a plane wave channel (20), in the surface (26) of which plane wave channel directed towards the diaphragm (12) there are adjacent sound inlet apertures (24) for transmitting acoustic waves into ducts (23) and, on the opposite side (22) of the plane wave channel, there are outlet apertures (25) for transmitting acoustic waves from the ducts into a horn portion (30). The ducts (23) taper so that the width (B) of the outlet apertures located in a row on the side of the horn portion is less than half the diameter (D) of the diaphragm.

8 Claims, 15 Drawing Sheets

METHOD TO GENERATE A PLANE ACOUSTIC WAVE FRONT, A PLANE WAVE CHANNEL, A LOUDSPEAKER CONSTRUCTION AND A LINEAR LOUDSPEAKER ARRAY

This application claims priority of Finnish patent application No. 20040623 filed Apr. 30, 2004, which is incorporated herein by reference.

OBJECT OF THE INNOVATION

The object of the present innovation is a method to generate a substantially plane acoustic wave front from a wave front, i.e. a radiation pattern, emitted by the diaphragms of the speaker elements of a combination of two or more loudspeakers, i.e. a linear loudspeaker array. The loudspeakers are usually placed above each other to create a linear loudspeaker array.

Another object of the present innovation is a plane wave channel arranged to be in connection with a loudspeaker construction, the plane wave channel comprising a part of a loudspeaker construction according to the invention, but the plane wave channel may also be added to old loudspeakers.

A further object of the present innovation is a loudspeaker construction, which comprises

- a loudspeaker enclosure, a speaker element installed in the enclosure and a horn portion,
- and in which loudspeaker construction there is a compression part is arranged in connection with the speaker element, which compression part is created by a space between the diaphragm of the speaker element and, at a distance from the cone, a wall or an object.

The object of the present innovation is furthermore a linear loudspeaker array that has two or more adjacent loudspeakers in close proximity to each other so that the loudspeakers jointly generate an acoustic wave front of the required shape and direction.

PRIOR ART

An electric signal fed into the voice coil of a speaker element in a loudspeaker causes the voice coil to vibrate in a magnetic field. A diaphragm or a sound cone attached to the voice coil will then vibrate correspondingly and generate corresponding pressure waves, which are audible as an acoustic sound signal. In terms of shape, the wave produced by the diaphragm of a speaker element is a spherical wave, although, as the frequency of the sound wave increases and the wave length decreases, the shape of the wave becomes similar to that of the diaphragm, and as a result of this, the directional pattern of the sound wave becomes narrower as the frequency increases. This may be prevented by reducing the size of the diaphragm, but a reduction of the area of the diaphragm causes impairment of the acoustic power and reduction of the loudspeaker efficiency.

Acoustic power may be increased by adding a horn in front of the speaker element. However, the throat of the horn is usually equal in size to the diaphragm of the speaker element, and thus the air space in front of the loudspeaker acts as a damper when the frequency increases.

In order to increase the upper frequency limit of the loudspeaker, it is known to place a compression component in connection with the diaphragm of a speaker element, in which compression component such a solid object is located in front of the diaphragm that a compression chamber is created between the diaphragm and the object. With the compression component, the pressure wave emanating from the diaphragm may be more adequately controlled, and thus the upper frequency limit increases and the loudspeaker construction works in a more linear fashion. A loudspeaker construction of this kind is therefore preferred, particularly at high sound frequencies.

Known solutions in the use of a compression chamber in a loudspeaker construction are presented in the publications U.S. Pat. No. 4,181,193, U.S. Pat. No. 4,776,428 and U.S. Pat. No. 6,094,495. A problem affecting the presented solutions is the existence of a phase difference due to the unequal distances of propagation of the pressure wave from different points on the diaphragm of a speaker element to the inlet aperture of the compression chamber. This causes deterioration of reproduction as the frequency increases within the reproduction band of the diaphragm.

It is known to place a plurality of loudspeakers above each other to create a so-called linear loudspeaker array. The aim of this is that the pressure waves from the various loudspeakers of the linear loudspeaker array should jointly generate a maximally plane pressure wave front. This, however, cannot be achieved very well with known loudspeakers because spherical parts of a sound wave front are generated in the pressure wave front at each loudspeaker. The sound wave front is thus non-plane, and the distances between its various parts and the diaphragms of the speaker elements vary greatly. In a linear loudspeaker array, however, the differences between the distances that different sound waves emanating from various points on the diaphragms of the loudspeakers travel to the outer surface of the loudspeaker may not be greater than a fourth of the wavelength of the reproduced frequency. This target cannot be achieved very well up to the upper frequency limit of the diaphragm with known loudspeaker solutions.

At an acoustic frequency of 3.5 kHz, the wavelength is approx. 100 mm, in which case the maximum difference between the distances that different sound waves emanating from various points on the diaphragms travel to the outer surface of the loudspeaker may be approx. 25 mm. Such a value cannot be reached with known loudspeaker and linear loudspeaker array solutions. In practice loudspeaker solutions often comprise combined bass, midrange and high-frequency loudspeakers. A solution according to the invention can be used in a very wide band of frequencies, but here it is most preferred in the midrange of the frequency range of human hearing, i.e. between 300 and 5,000 Hz.

OBJECT OF THE INVENTION

It is an object of the invention presented here to create a method for generating from the radiation pattern of a linear loudspeaker array a plane acoustic wave front. It is another object of the present invention also to create a new linear loudspeaker array, a better loudspeaker construction and a better linear loudspeaker array that overcomes the aforementioned drawbacks.

CHARACTERISTICS OF THE METHOD ACCORDING TO THE INVENTION

The method according to the invention is characterised in that

- spherical acoustic wave fronts emitted by the diaphragms of the speaker elements of a linear loudspeaker array are transformed into a uniform, substantially planar acoustic wave front in such a way that
- an acoustic wave front produced by the diaphragm of a single speaker element is transmitted through the acoustic ducts of a plane wave channel, the distances travelled by sounds emitted from different points on the diaphragm in the acoustic ducts of the plane wave channel are substantially equal, the components of an acoustic wave front emitted from a substantially spherical diaphragm are narrowed down in adjacent acoustic ducts of the plane wave channel into a narrow row, so that the width of the outlet apertures of adjacent acoustic ducts of the plane wave channel is less than half the diameter of the diaphragm.

In a linear loudspeaker array provided with plane wave channels, spherical acoustic wave front generated by adjacent loudspeakers are transformed into a substantially uniform and planar acoustic wave front, which is emitted from a row of adjacent apertures.

Characteristics of the Plane Wave Channel According to the Invention

The plane wave channel according to the invention is characterised in that adjacent ducts of the plane wave channel are most preferably tapering, and the outlet apertures on the side of the horn portion of the plane wave channel create a row of adjacent apertures, the width of which apertures in the transverse direction of the plane wave channel, on its outer surface, is less than the diameter of the speaker element arranged in connection with the plane wave channel.

The loudspeaker construction according to the invention is characterised in that in the loudspeaker construction, there is a plane wave channel between the speaker element and the horn portion, in which plane wave channel there is a plurality of ducts for transmitting acoustic waves through the plane wave channel, in such a way that the plane wave channel transforms the spherical pressure wave pattern of the sound waves generated by the diaphragm of the speaker element into a plane wave, in the plane wave channel, the surface directed towards the diaphragm is substantially similar in shape to the diaphragm so that the narrow gap remaining between the plane wave channel and the diaphragm is substantially equal in size throughout the diaphragm, in the surface of the plane wave channel directed towards the diaphragm, there are sound inlet apertures for transmitting acoustic waves into the ducts and, on the opposite side of the plane wave channel, there are outlet apertures for transmitting acoustic waves from the ducts into the horn portion, the inlet apertures of the ducts of the plane wave channel are most preferably parallel longitudinal slits, which slits are located across the area of the diaphragm of the speaker element so that the length of each longitudinal slit substantially corresponds to the width of the diaphragm at the location of the slit in question, viewed in the direction of sound propagation, the dimensions of the ducts of the plane wave channel change in such a way that the widths of the narrow slits of the inlet apertures increase and the lengths decrease so that adjacent outlet apertures on the opposite side of the wave length channel are most preferably of equal width.

Using a loudspeaker construction according to the invention, provided with a plane wave channel, the spherical radiation pattern of acoustic waves generated by a speaker element can be transformed into a plane wave.

According to the invention, a small air space remains between the plane wave channel and the diaphragm of a speaker element, from which air space the acoustic signal of the pressure waves generated by the vibration of the diaphragm is transmitted through the ducts to the inlet aperture of the plane wave channel. The dimensions of the ducts are determined in such a way that the distances from any point between the diaphragm and the plane wave channel to the inlet aperture of the plane wave channel, to the summing plane, are substantially equal. A plane pressure wave front is thus generated at the inlet apertures of the plane wave channel, which pressure wave front is transmitted out of the loudspeaker construction with the help of the horn portion.

Because the differences between single radiation points of the pressure wave front between the diaphragm and the plane wave channel in the distances from the summing plane of the outlet apertures of the plane wave channel determine the upper frequency limit of the reproduction range of the loudspeaker construction, the upper frequency limit can be increased substantially with a loudspeaker construction according to the invention. At the same time, the efficiency of a loudspeaker construction comprising a speaker element, plane wave channel and a horn increases thanks to a better acoustic adaptation.

The linear loudspeaker array according to the invention is characterised in that the linear loudspeaker array is located in front of the speaker element, at least some of the loudspeakers in the linear loudspeaker array are provided with a plane wave channel, in which plane wave channel there is a plurality of adjacent ducts such that connect the air space in the proximity of the diaphragm with the outer surface of the plane wave channel, in the linear loudspeaker array, the adjacent ducts of the plane wave channel are most preferably tapering and the outlet apertures on the outer surface of the plane wave channel create a row of adjacent apertures, the width of which apertures in the transverse direction of the plane wave channel, on its outer surface, is less than the diameter or width of the diaphragm of the speaker element arranged in connection with the plane wave channel at the corresponding point.

EMBODIMENTS OF THE INVENTION

A preferred embodiment of the loudspeaker construction according to the invention is characterised in that, in the loudspeaker construction, the total surface area of the inlet apertures of the plane wave channel is approximately one third of the surface area of the diaphragm of the speaker element.

Another preferred embodiment of the loudspeaker construction according to the invention is characterised in that two or more units of the loudspeaker construction are mutually connected so that the outlet apertures of adjacent plane wave channels are facing in the same direction and of substantially equal size.

A third preferred embodiment of the loudspeaker construction according to the invention is characterised in that two or more units of the loudspeaker construction are mutually connected on top of or parallel with each other, so that the outlet apertures of mutually equal width in plane wave channels located on top of or parallel with each other create a uniform, narrow, vertically or horizontally oriented row.

By connecting a plurality of loudspeaker constructions according to the invention with each other, a uniform, planar pressure wave showing vertical or horizontal continuity can be generated. Particularly preferred is a radiator solution with units placed on top of one another, which makes it possible to adjust the radiation pattern of the pressure wave radiator by changing the angles between the units of the loudspeaker construction.

Embodiments

In the following, the invention is described using examples with reference to the accompanying drawings, in which

LIST OF FIGURES

FIG. 1 represents schematically the method according to the invention for generating a plane wave.

FIG. 2 represents an axonometric projection of the plane wave channel according to the invention.

FIG. 3 represents the plane wave channel in FIG. 2 seen from the side of the speaker element.

FIG. 4 represents an axonometric projection the plane wave channel in FIG. 1 seen from the opposite side.

FIG. 5 represents, as an axonometric vertical section, one half of the plane wave channel in FIG. 1.

FIG. 6 represents a sectional view of FIG. 3 along line VI-VI.

FIG. 7 represents a sectional view of FIG. 3 along line VII-VII.

FIG. 8 represents a sectional view of FIG. 3 along line VIII-VIII.

FIG. 9 represents a vertical sectional side view of a loudspeaker according to the invention.

FIG. 10 represents a sectional view of FIG. 9 along line X-X.

FIG. 11 represents an axonometric projection of plane wave channels according to the invention mutually connected on top of one another.

FIG. 12 represents a vertical sectional side view of loudspeakers according to the invention mutually connected on top of one another.

FIG. 13 represents a vertical sectional side view of loudspeakers according to the invention mutually connected on top of one another according to another embodiment of the invention.

FIG. 14 represents a horizontal sectional top view of mutually connected loudspeakers according to the invention according to a third embodiment of the invention.

FIG. 15 represents a horizontal sectional top view of mutually connected loudspeakers according to the invention according to a fourth embodiment of the invention.

FIG. 16 corresponds to FIG. 9 and represents a vertical sectional side view of a loudspeaker according to the invention according to another embodiment of the invention.

FIG. 17 represents a sectional view of FIG. 16 along line XVII-XVII.

DESCRIPTION OF THE FIGURES

FIG. 2 illustrates that the lengths of the inlet apertures 24, i.e. the horizontal slits, correspond to the width of the speaker element, indicated with broken lines, at the location of the respective slit. In other words, the ends of the slits substantially reach the edges of the speaker element. Thus a sufficient pressure surface 26 remains on the surface 21 of the plane wave channel 20, between the slits 24, which pressure surface comes so close to the diaphragm of the speaker element that a narrow gap, i.e. a so-called compression chamber, is formed between the surface 26 and the diaphragm.

Figure 1:
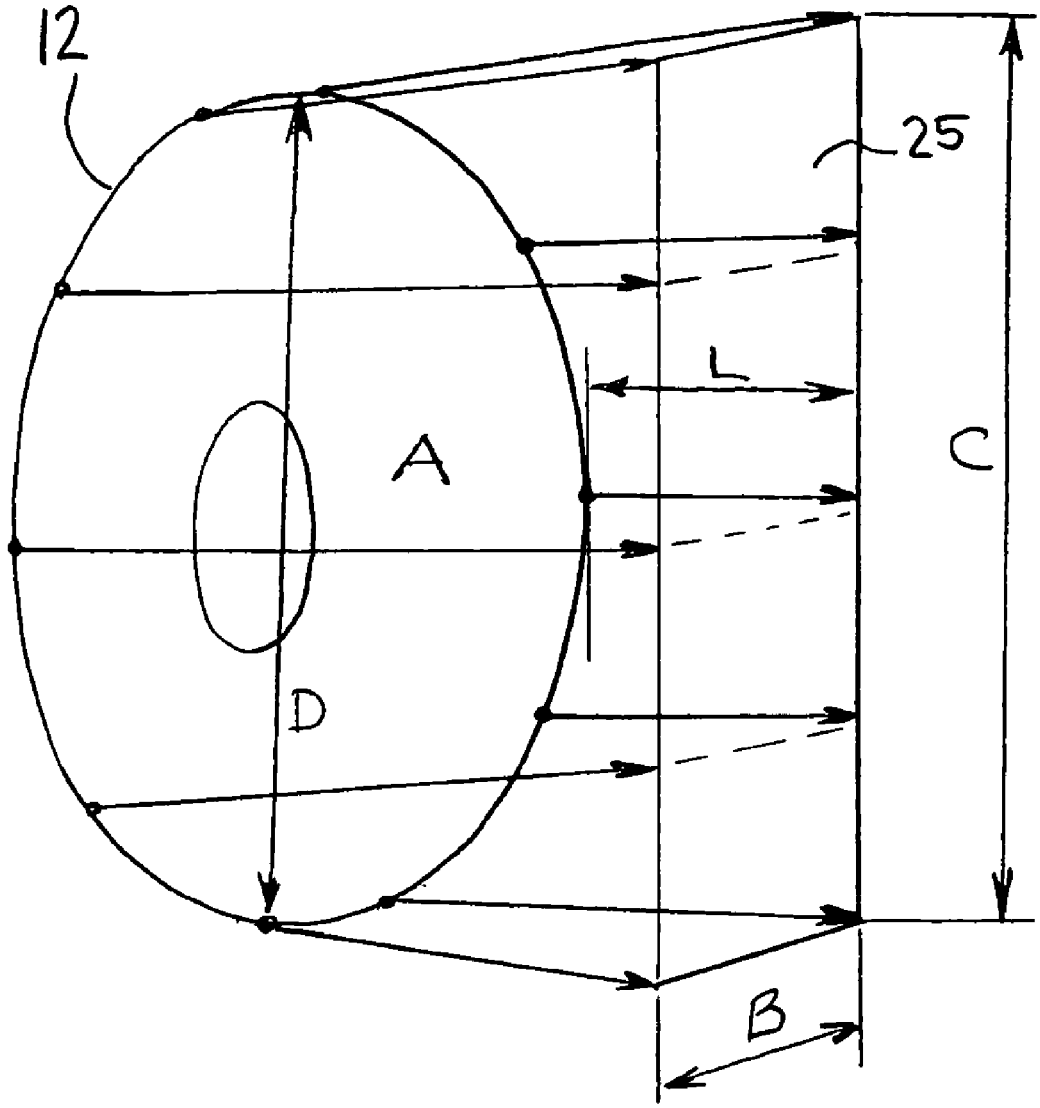
FIG. 1 shows a schematic view of the method according to the invention for generating a plane wave in a loudspeaker construction. In the figure, a spherical diaphragm of a speaker element is indicated by the reference number 12, the diameter of which cone is D and the surface area A. According to the invention, the pressure wave of a sound emitted from the diaphragm 12 is transmitted through a plane wave channel for a distance L, via one or a plurality of ducts, so that the sound exits from ducts of the plane wave channel via outlet apertures, which outlet apertures jointly create a narrow rectangular area of the width B and height C. The benefit achieved with the invention is that a spherical acoustic wave front emitted from the diaphragm 12 is transformed, when proceeding through the plane wave channel, into a plane acoustic wave front, which exits the device through the rectangular outlet aperture 25.
Figure 2:
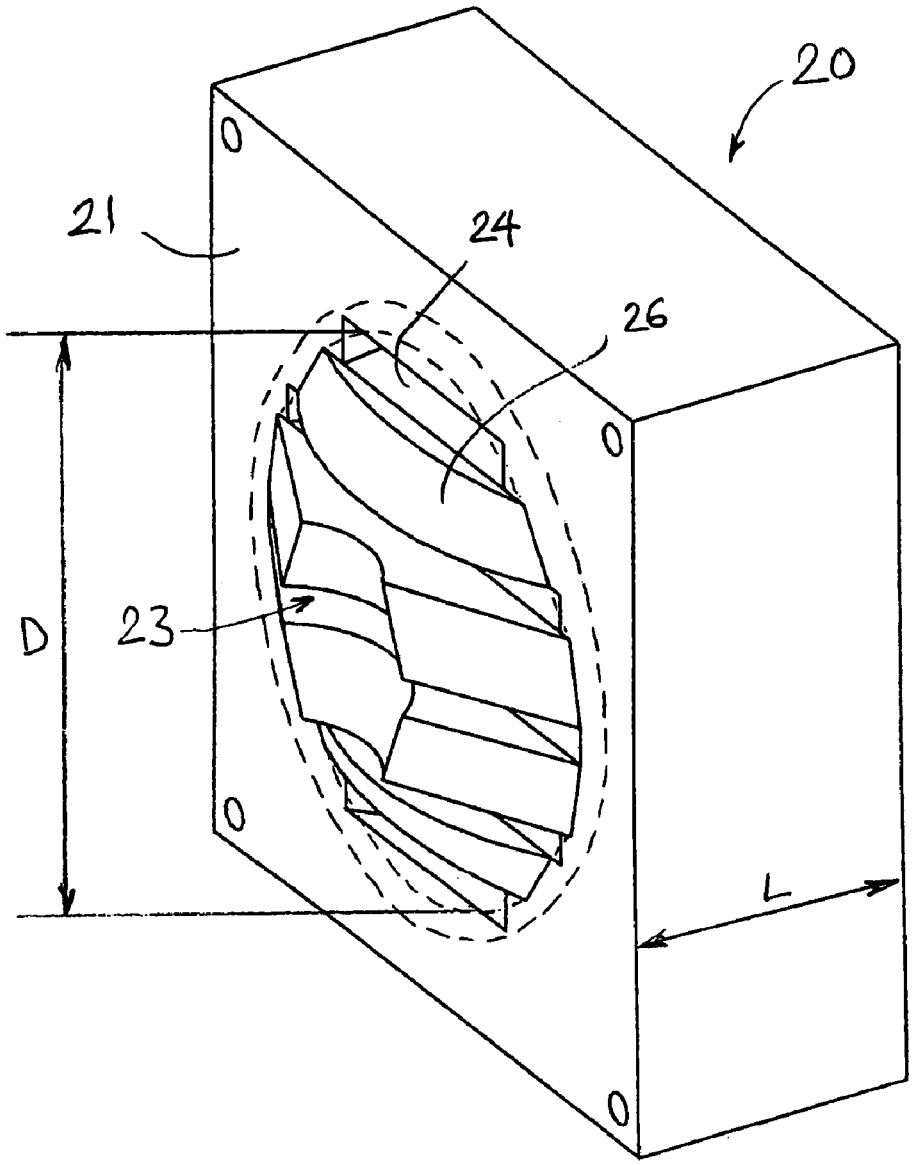
FIG. 2 shows the plane wave channel 20 according to the invention, in which plane wave channel the surface 21 facing towards the speaker element is shaped so as to correspond to the shape of the diaphragm of the speaker element. The location of the speaker element is indicated by broken lines in FIG. 2. In the surface 21 on the side of the plane wave channel 20 facing towards the speaker element, inlet apertures 24 have been arranged, in the area of the speaker element, which inlet apertures, in the example represented by FIG. 2, are horizontal and mutually parallel slits, the width of which slits substantially corresponds to the width of the diaphragm at the corresponding point. The inlet apertures 24 may, however, be also be oriented in another direction, and they do not necessarily have to be parallel. At the location of the inlet apertures 24, acoustic ducts 23 pass through the plane wave channel 20.
Figure 3:
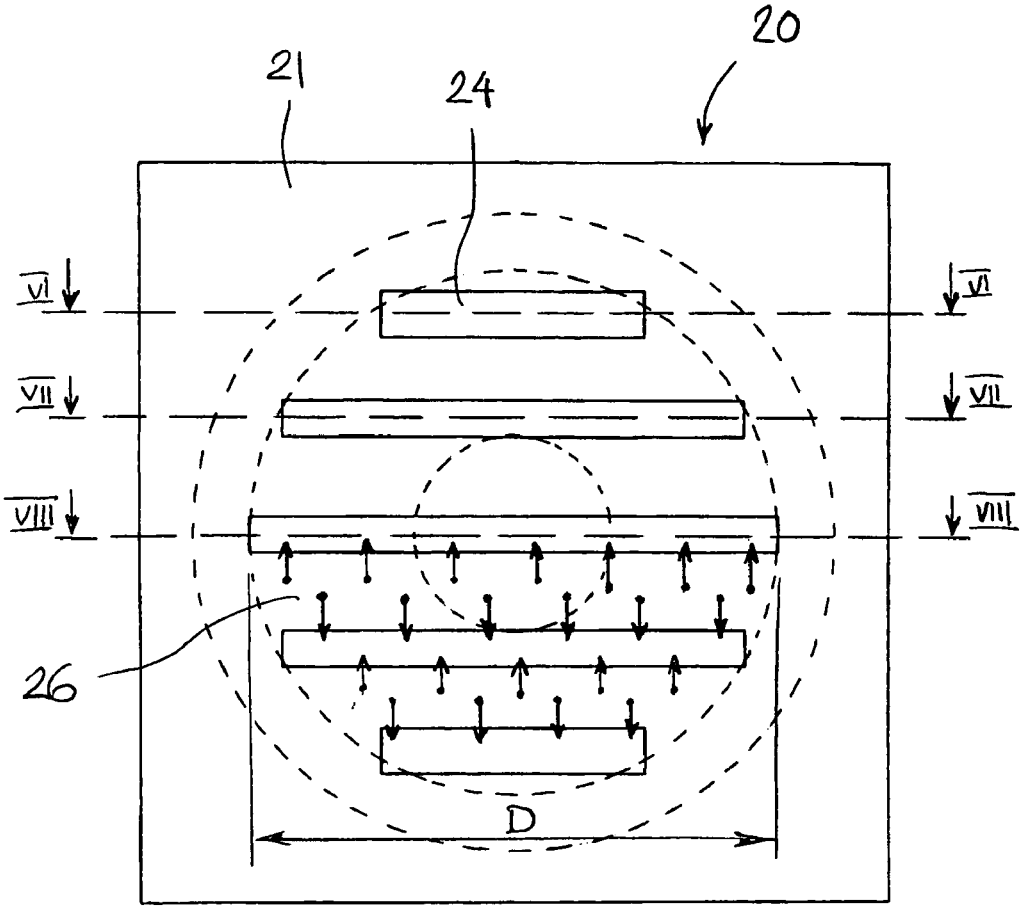
FIG. 3 shows the plane wave channel 20 of FIG. 2 seen perpendicularly from the side as seen from the side 21 facing the speaker element. The figure clearly illustrates that the slits formed by the inlet apertures 24 are restricted to the area of the speaker element, which is marked with broken lines. The slits 24 are parallel so that pressure surfaces 26 remain between them, which pressure surfaces form a narrow, gap-shaped compression chamber with the diaphragm of the speaker element. The total surface area of the pressure surfaces 26 is approximately two thirds of the surface area A of the diaphragm of the speaker element, and the total surface area of the slits 24 of the inlet apertures is approximately one third of the surface area A of the diaphragm of the speaker element.

If the nominal size of the speaker element used in the examples shown in FIGS. 2 and 3 is 200 mm, the diameter D of the diaphragm of the speaker element is approx. 190 mm. This means that the surface area A of the diaphragm is approx. 2.8 $dm^2$. Because the total surface area A1 of the inlet apertures 24 of the surface 21 of the plane wave channel 20, which surface faces towards the speaker element, is most preferably approximately one third of the A, i.e. A/3, the total surface area of the apertures is most preferably approx. 0.7-0.9 $dm^2$. The inlet apertures of the plane wave channel may not be too big so as not to excessively reduce the upper frequency limit of the reproduced range. The compression surface area remaining between the inlet apertures 24 is most preferably approximately two thirds of the surface area A of the diaphragm, i.e. 2A/3, which in this example is approx. 1.9-2.1 $dm^2$.

FIG. 3 clearly illustrates how the compression chamber created between the diaphragm of the speaker element and the plane wave chamber 20 functions. The distance from any point on the pressure surface 26 to any inlet aperture 24 is no greater than a half of the distance between the inlet apertures 24. This distance, i.e. half of the distance between the inlet apertures 24, has a substantial influence on the upper frequency limit of the sound reproduced by a loudspeaker construction according to the invention. However, the decisive factor that influences the upper frequency limit is the total distance that a sound wave has to travel from the various points on the pressure surface 26 of the compression chamber to the summing plane created by the outlet apertures on the opposite side of the plane wave chamber 20, as the following figures illustrate in greater detail.

Figure 4:
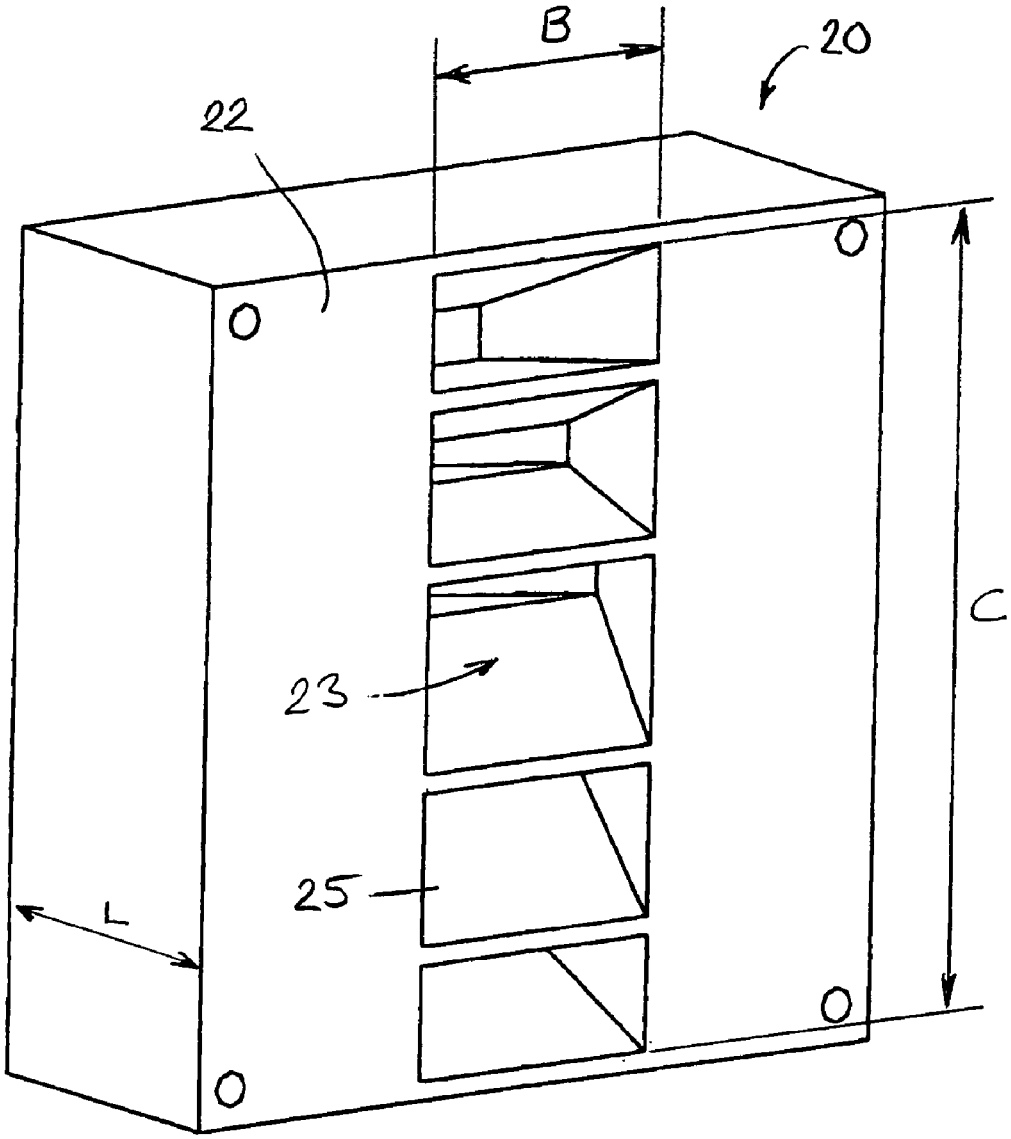

FIG. 4 illustrates the plane wave channel 20 of FIG. 3 seen from the opposite side. The figure also illustrates that acoustic ducts 23 coming from the speaker element on the opposite side of the plane wave channel 20 terminate in the outlet apertures 25. The acoustic ducts 23 are tapered in the horizontal direction inside the plane wave chamber 20, i.e. in the lateral direction in FIG. 4, so that the slits 24 of different width illustrated in FIG. 3 have become clearly narrower outlet apertures 25 of equal width at the opposite end of the ducts 23. The width B of the outlet apertures 25 is most preferably less than half of the diameter D of the diaphragm of the speaker element, i.e. B<D/2. At the same time, however, the ducts 23 starting from the slits 24 become wider in the vertical direction so that at the outlet apertures 25, the acoustic ducts 23 are no longer slits but rather definite apertures 25, which apertures are so close to each other that they are almost in contact with each other. Even though the ducts 23 taper laterally in the direction of sound propagation, their extensive widening in the vertical direction results in the cross sections of the ducts 23 increasing approximately twofold. The total height of the apertures in the outer surface 22 of the plane wave channel 20 is greater than the diameter D of the diaphragm of the speaker element, i.e. C>D.

Figure 5:
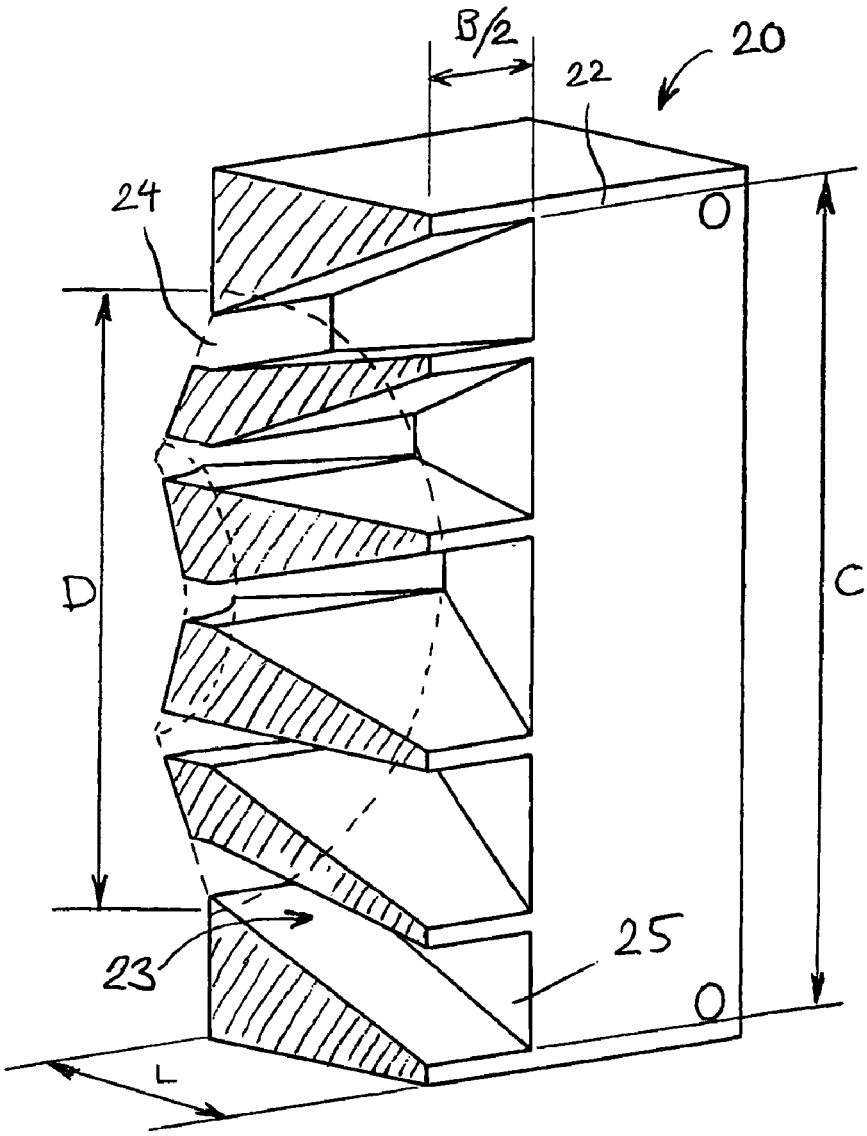

FIG. 5 represents a half of the plane wave channel 20 shown in FIGS. 2-4, which illustrates clearly the shape of the acoustic ducts 23. The half shown in the figure may also be considered as an object to be manufactured as such according to one embodiment of the invention. During assembly, the plane wave channel 20 can be assembled to a finished condition by joining the two said halves together.

In FIG. 5, the ducts 23 of the plane wave channel 20 start from the proximity of the diaphragm of the speaker element, from the inlet apertures 24, and terminate in the outlet apertures 25. The figure shows that in the vertical direction the ducts 23 expand radially in the direction of sound wave propagation and at the same time taper in the horizontal direction. In FIG. 5, the width of one half of the outlet aperture 25 in the outer surface 22 of the plane wave channel 20 is indicated by B/2, which means that B/2<D/4 when D indicates the diameter of the diaphragm of the speaker element.

In the example mentioned above, where the diameter D of the diaphragm of the speaker element is 190 mm, the width B of the outlet apertures 25 of the plane wave channel 20 is less than D/2, i.e. approx. 70-95 mm, most preferably B=approx. 0.4 D, i.e. 70 mm. In this case the maximum frequency, i.e. the upper frequency limit of the range mainly intended to be reproduced is approx. 5 kHz and the corresponding minimum wavelength is approx. 70 mm. In the vertical direction, the total height of the outlet apertures 25 is greater than the diameter D of the diaphragm of the speaker element, i.e. C>D, most preferably approx. 210 mm. In this case the total surface area A2 of the outlet apertures 25 of the outer surface 22 of the plane wave channel is most preferably approximately twice the total surface area A1 of the inlet apertures 24. When the total surface area A1 of the inlet apertures 24 of the plane wave channel 20 is approx. 0.7-0.9 $dm^2$, the total surface area A2 of the outlet apertures 25 is in this example most preferably twice that area, i.e. approx. 1.9-2.1 $dm^2$. The depth L of the plane wave channel 20, i.e. the length of the acoustic duct 23 leading from the diaphragm of the speaker element to the outer surface 22 of the plane wave channel is less than a half of the diameter D of the diaphragm of the speaker element, i.e. L<D/2, most preferably approx. 70 mm.

By tapering the ducts 23 and by means of the said design, the spherical pressure wave pattern of the sound produced by the diaphragm of the speaker element can be transformed into a narrow, uniform plane wave. According to the invention, the throat of the horn portion of the plane wave chamber 20 should be as narrow as possible so that the horn portion to be connected to the plane wave chamber 20 functions directionally in the desired way. The effect of the horn portion disappears and the directionality of the loudspeaker decreases if the throat of the horn portion, i.e. the outlet apertures of the plane wave chamber 20 are too wide.

A result of this structure is that, as a combined effect of widening and tapering in different directions, the distances from different points on the diaphragm of the speaker element to the corresponding points on the surface 22 of the plane wave channel 20 that is on the horn portion side, to the summing plane created by the outlet apertures 25, are substantially equal. As a result of this, the spherical acoustic wave pattern produced by the diaphragm of the speaker element is transformed into a planar pressure wave, in which no such detrimental attenuation phenomena occur as take place in adjacent spherical pressure waves.

Figure 6:
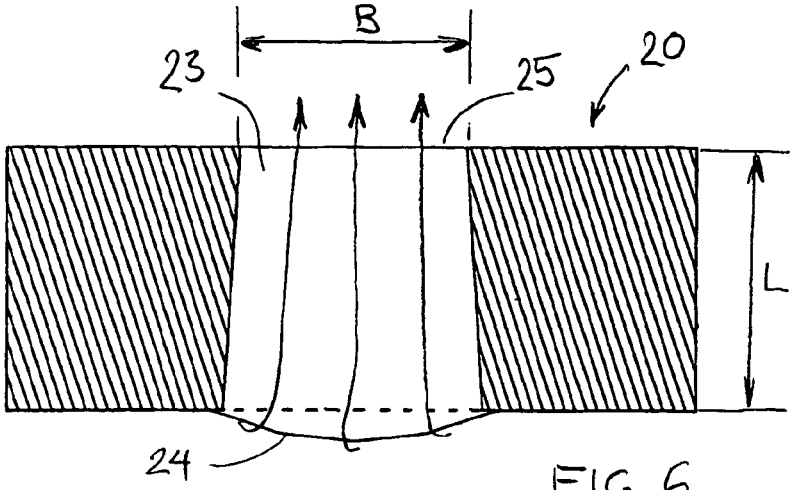
Figure 7:
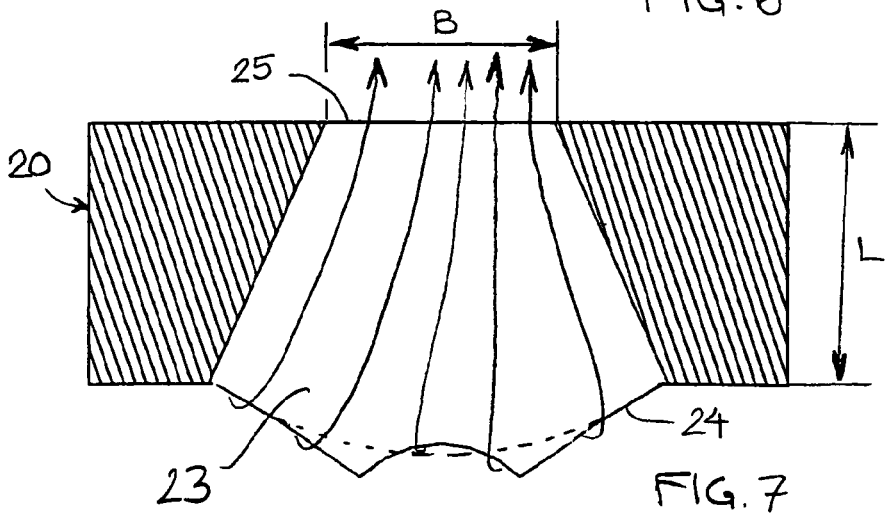
Figure 8:
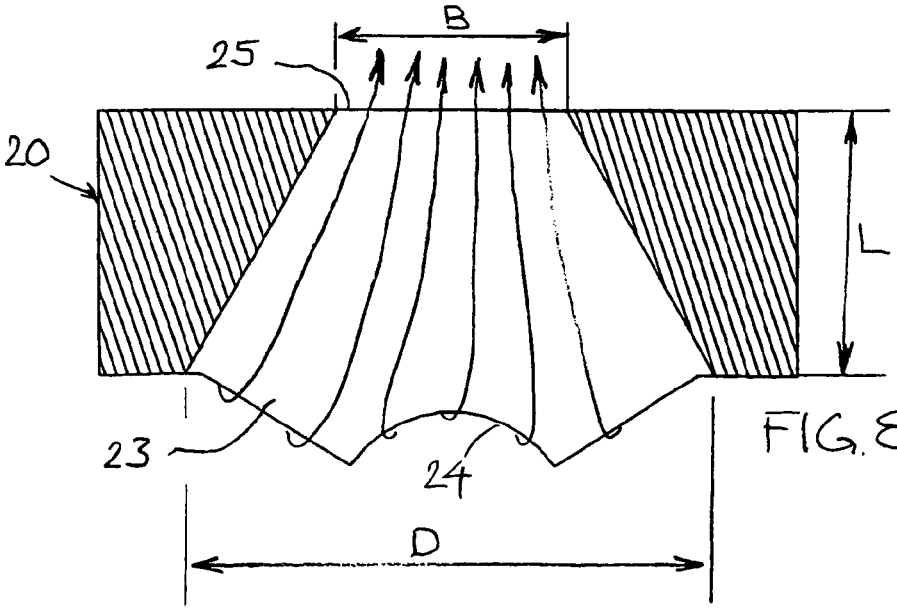

FIGS. 6-8 illustrate sound ducts 23 of the plane wave channel 20, the ducts being of different sizes and located at different points on the diaphragm of the speaker element. The duct 23 in FIG. 7 seems to be the shortest of them according to the figure. However, the inlet aperture 24 of the duct 23 in this figure is located on the upper edge of the diaphragm of the speaker element, from where the duct turns vertically upwards in a radial direction. A result of this direction of the duct 23 is that the distance travelled by a sound wave from the proximity of the diaphragm of the speaker element, i.e. from the inlet aperture 24 to the outlet aperture 25 is substantially equal in all of the cases illustrated in FIGS. 7-9.

Figure 9:
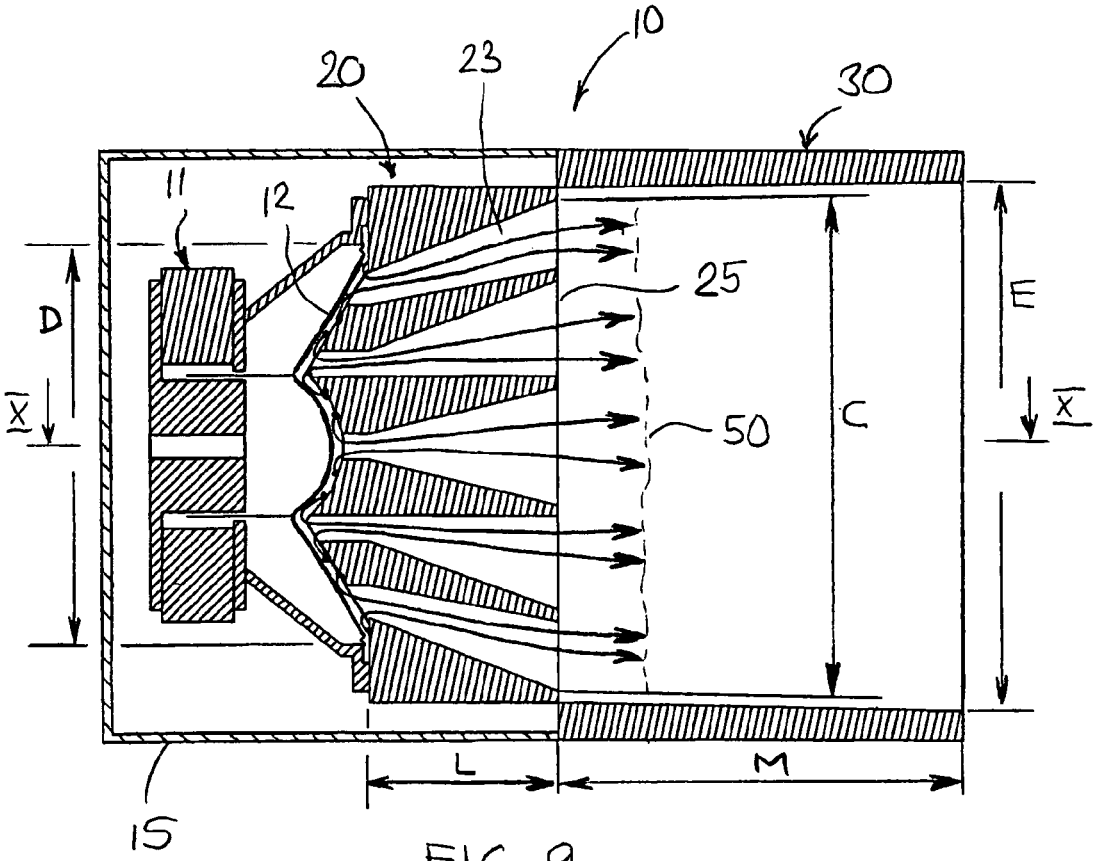

FIG. 9 represents a sectional view of a loudspeaker solution 10 according to the invention, which loudspeaker solution is comprised of a speaker element 11, an enclosure 15, a plane wave channel 20 and a horn portion 30. The figure illustrates that sound waves emitted from the various points of the compression gap between the diaphragm 12 of the speaker element 11 and the plane wave channel 20 travel substantially equal distances via the various ducts 23 to the outlet aperture 25 of the plane wave channel 20, in which outlet aperture the spherical wave that was emitted from the diaphragm 12 has thus been transformed into a plane wave. The acoustic pressure wave is amplified in the horn portion 20, the internal height of which is E. The length of the horn portion 30, i.e. the distance from the plane wave channel to the outer edge of the horn portion is M. In a vertical sectional view of the loudspeaker solution 10, the horn portion 30 does not look like a cone, but the height E of the horn portion 30 is, nevertheless, clearly greater than the diameter D of the diaphragm of the speaker element. The next figure, FIG. 10, shows a horizontal sectional view of the loudspeaker, which clearly illustrates the widening shape of the horn portion 30 in the lateral direction.

Figure 10:
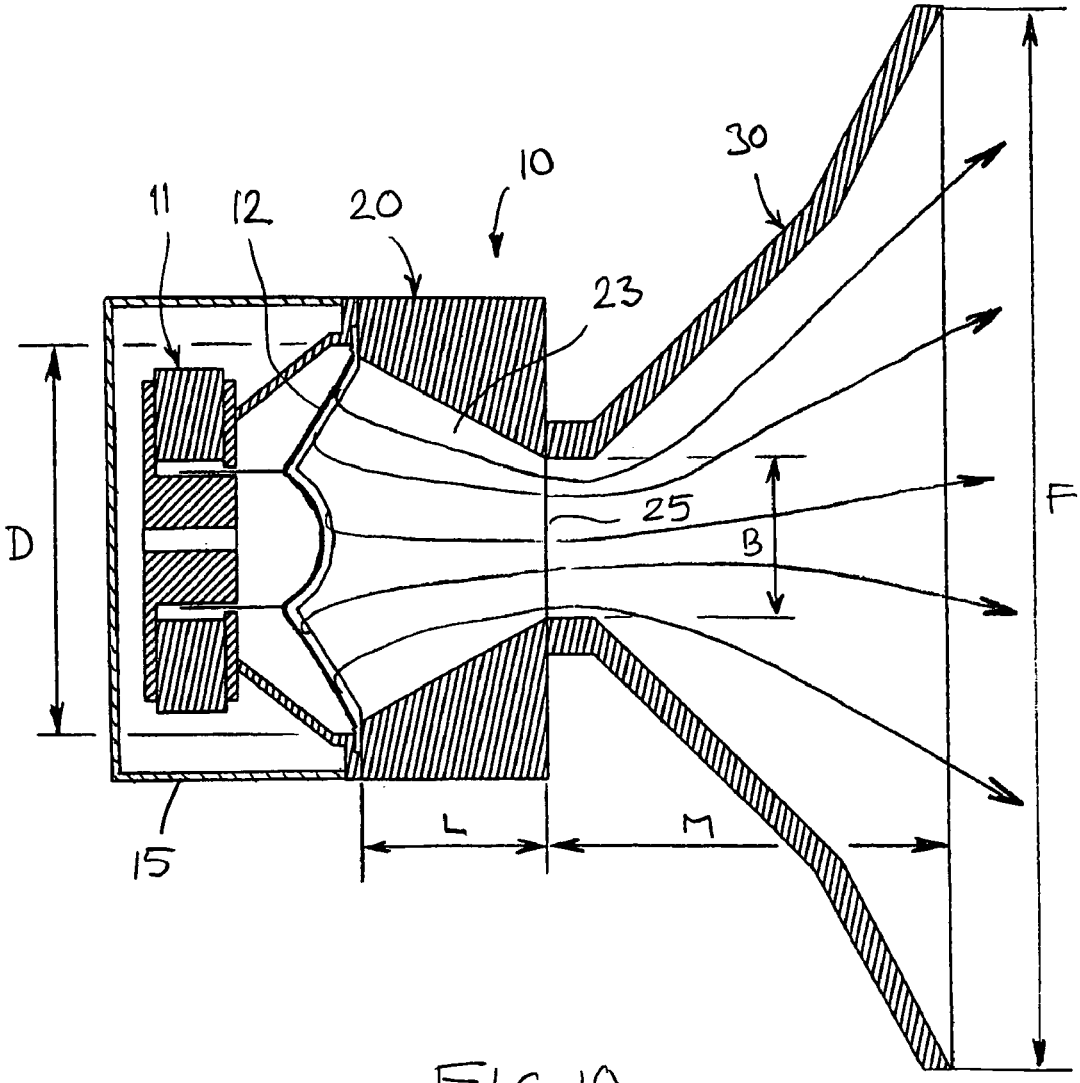

FIG. 10 represents the loudspeaker solution 10 of FIG. 9 as a horizontal sectional view, clearly illustrating the cone-like shape of the horn portion 30 and the tapering of the duct 23 of the plane wave channel 20. The cone of the horn portion 30 of the loudspeaker 10 widens exponentially.

Figure 11:
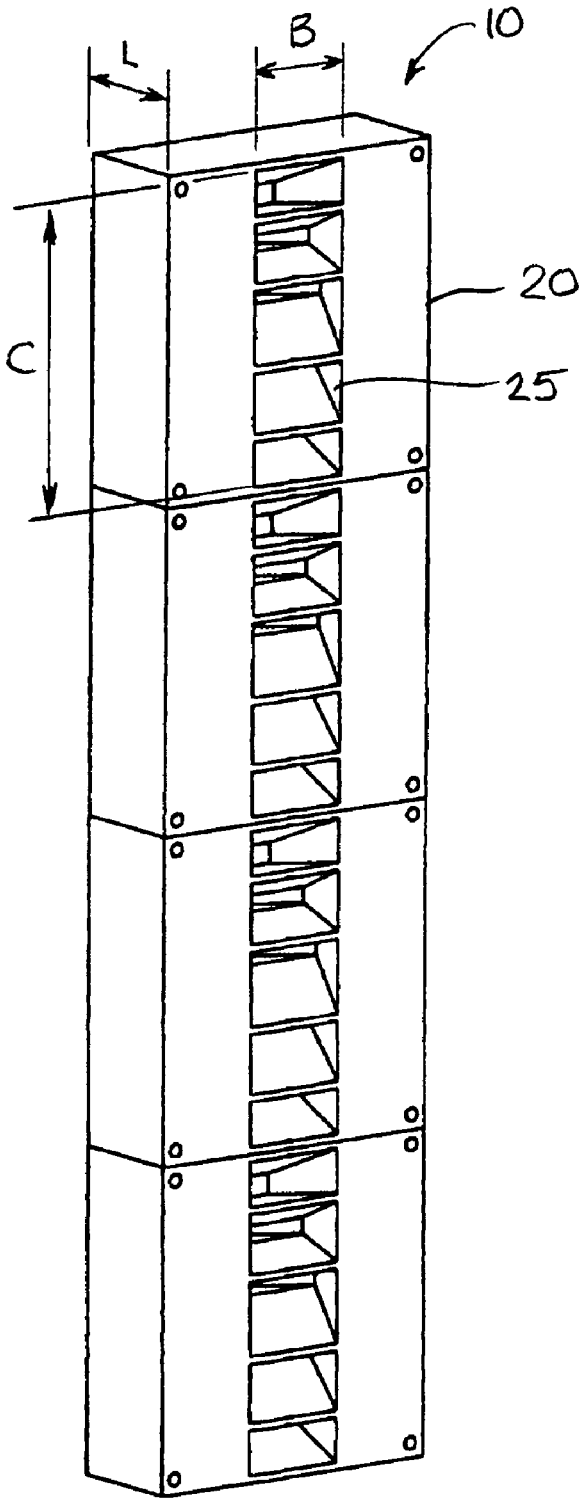

FIG. 11 illustrates plane wave channels 20 according to the invention mutually connected on top of one another. The figure clearly illustrates in a schematic fashion how a row of the narrow outlet apertures 25 of the plane wave channels 20 provides a vertical and nearly unified, tall aperture in the linear loudspeaker array. Through the narrow row of apertures of the linear loudspeaker array, the spherical sound wave patterns of each speaker element in connection with the plane wave channel 20 can be transformed into a uniform, planar pressure wave.

Figure 12:
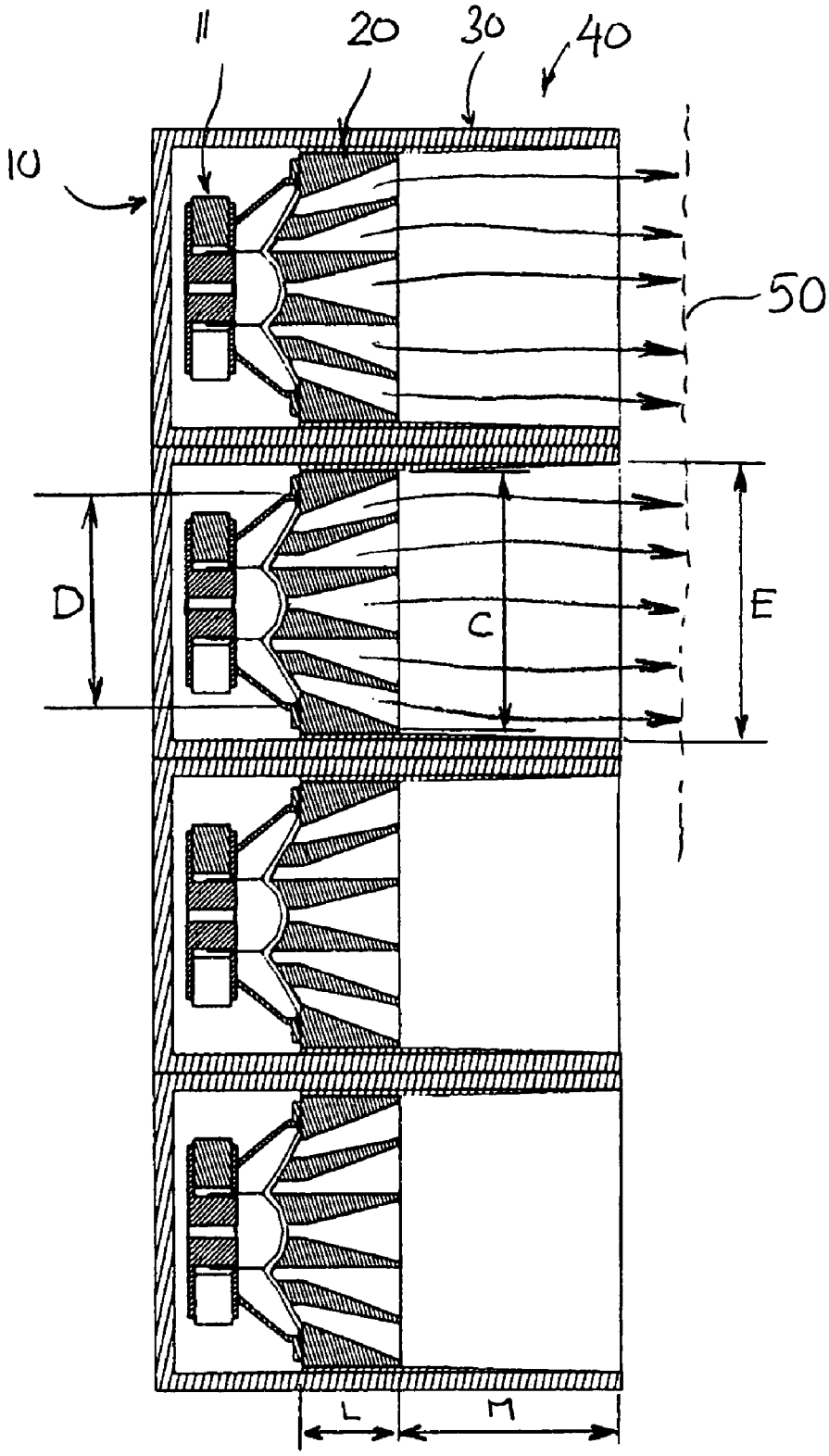
Figure 13:
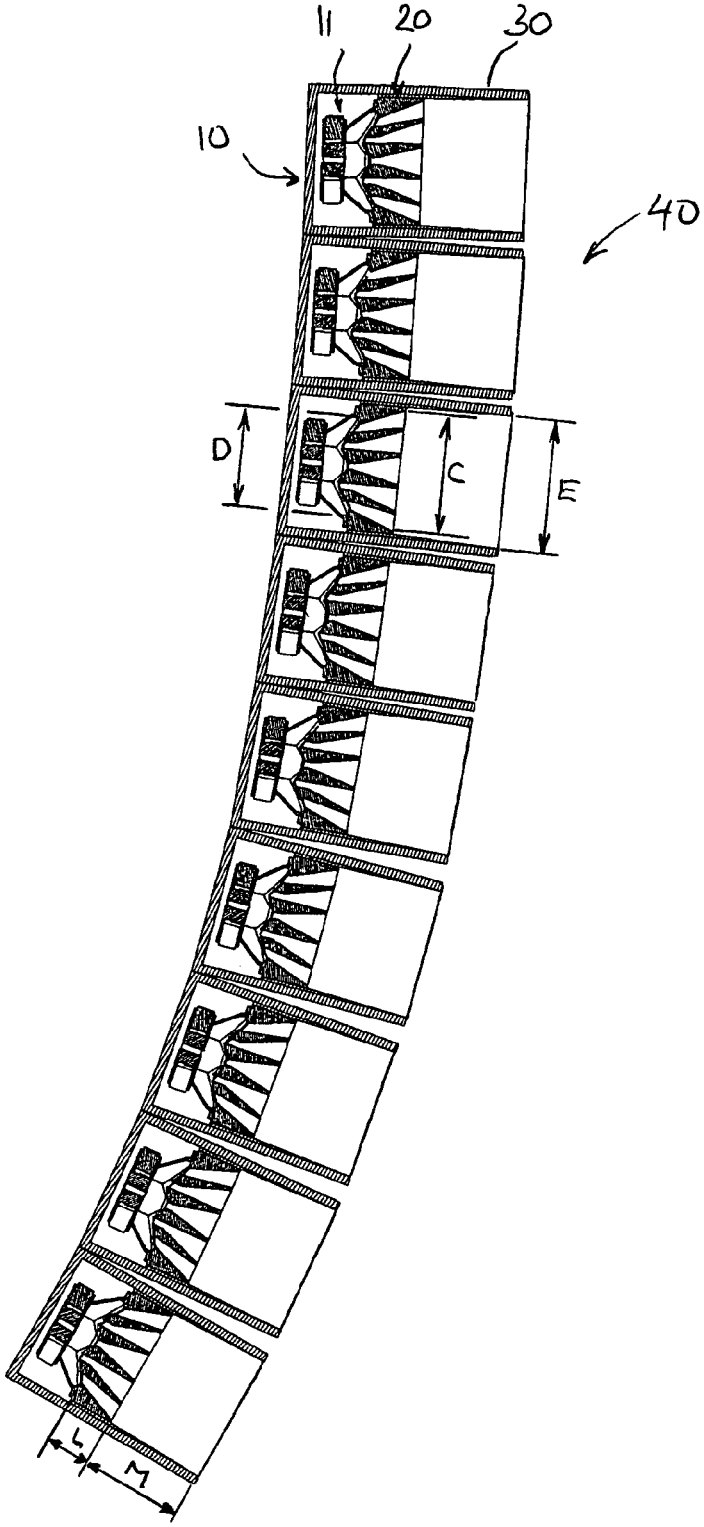

FIG. 12 illustrates a vertical sectional view of loudspeaker system units 10 according to the invention connected mutually on top of one another to create a linear loudspeaker array 40. All speaker units 10 may be horizontally positioned, as in FIG. 12, but they can also be directed in different directions, as shown in FIG. 13.

Figure 14:
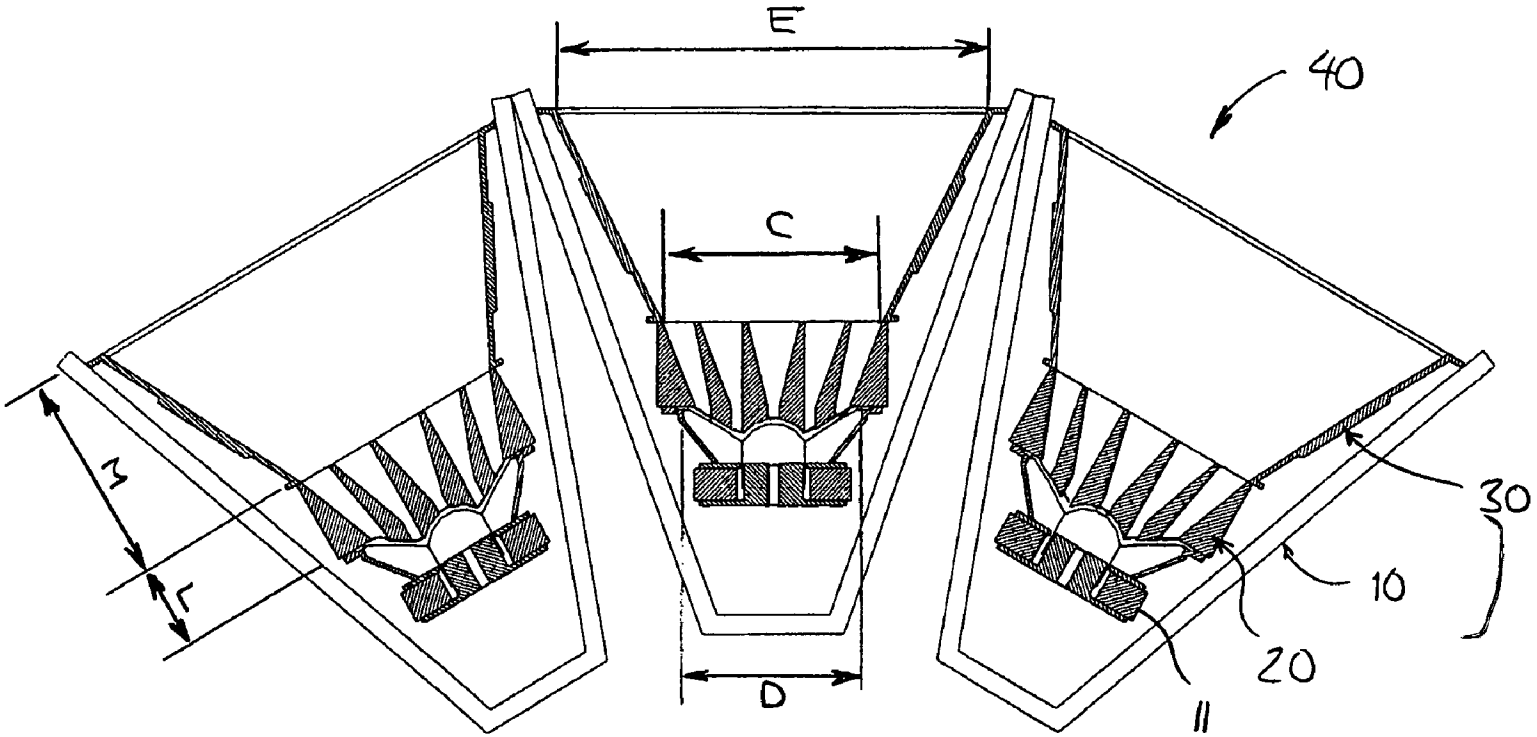
Figure 15:
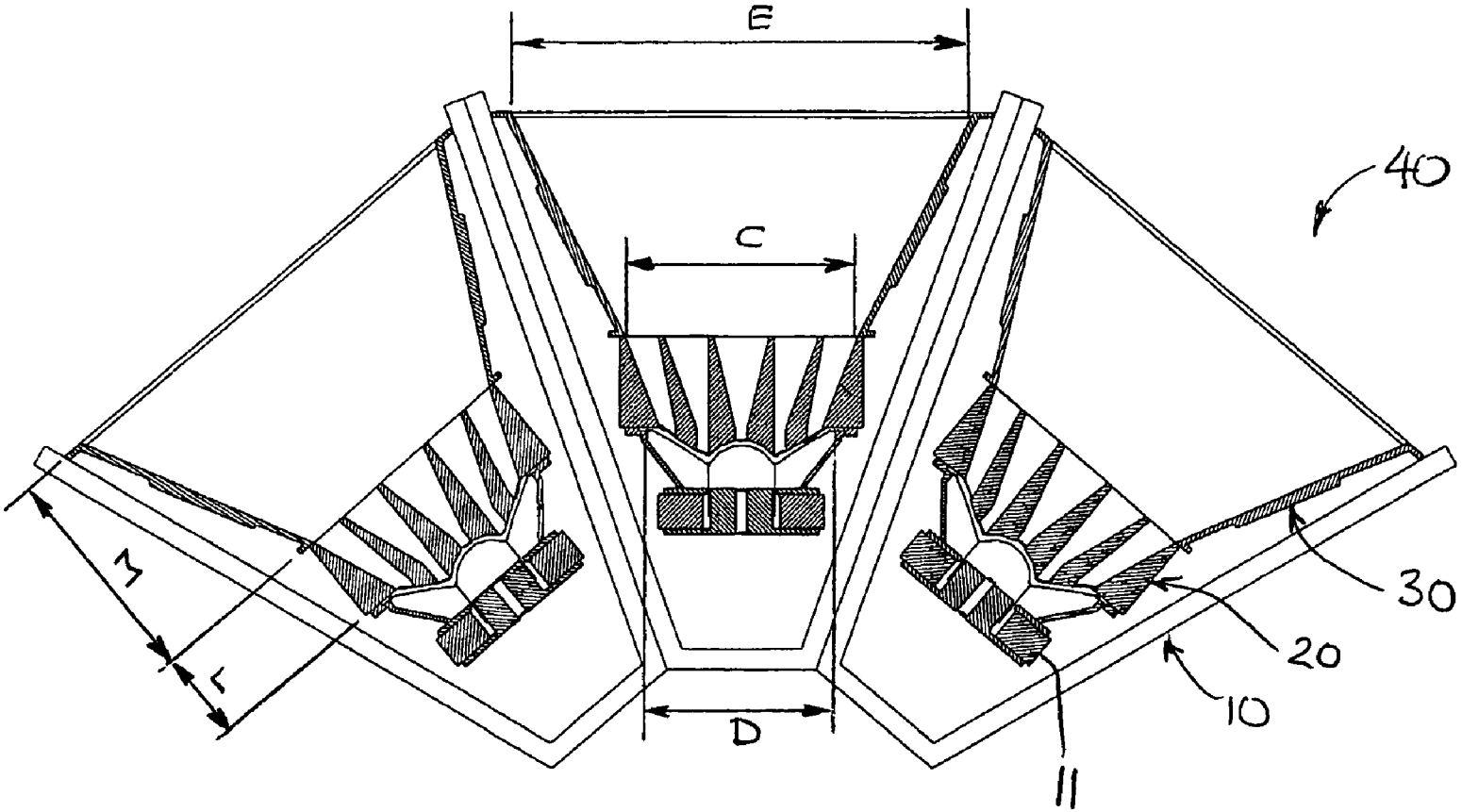

Loudspeaker system units 10 according to the invention can be mutually connected in various ways and also side by side horizontally, as shown in FIGS. 14 and 15. In FIG. 14, three units 10 of the speaker system, the width of the outlet aperture of the horn portion 30 of which units is E, create a directional pattern of 120° and in FIG. 15 the directional pattern is 90°.

Figure 16:
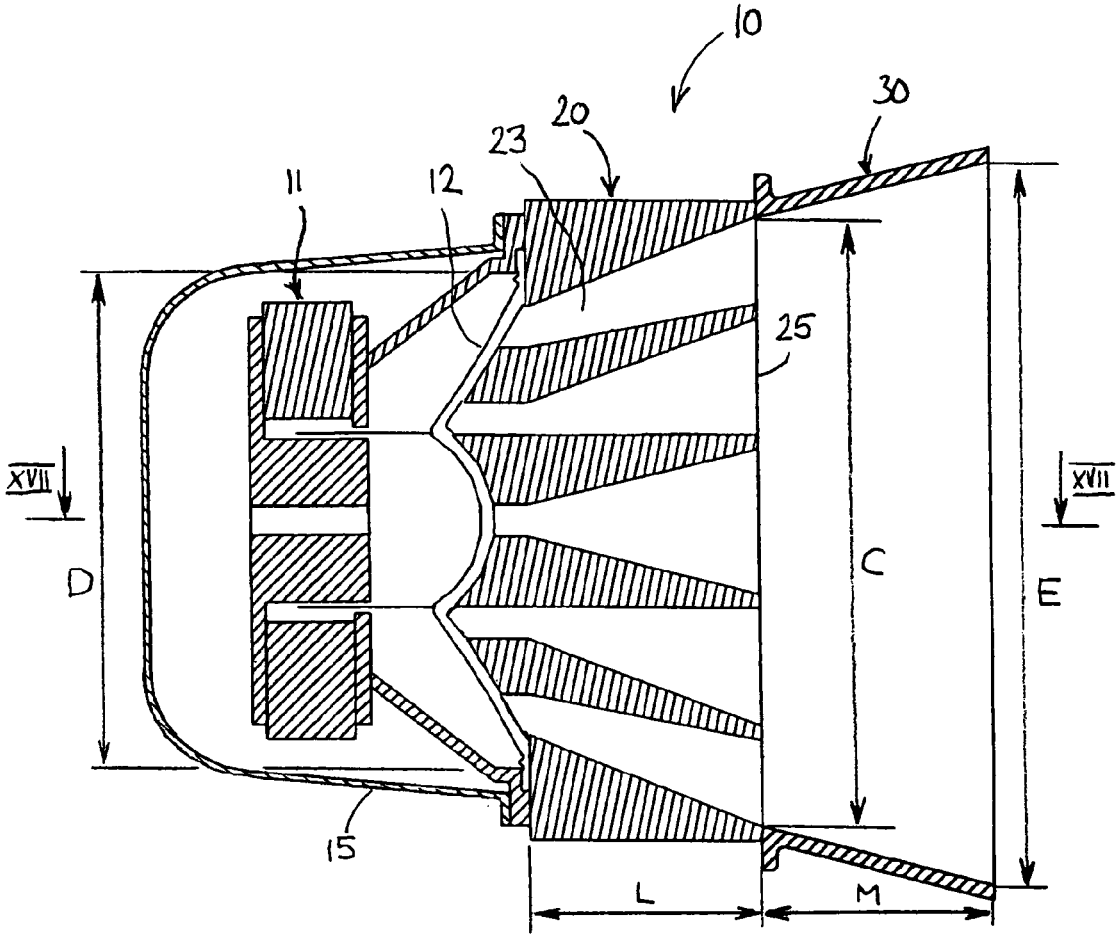

FIG. 16 shows another embodiment of the loudspeaker according to the invention. The figure illustrates that the ducts 23 in the plane wave channel 20 are directed so that the height C of the outlet aperture of the plane wave channel 20 is substantially greater than the diameter D of the diaphragm of the speaker element. The reason for this is that the outermost ducts 23 of the plane wave channel 20 are directed away from the central axis, i.e. the ducts are spread out. With this solution, the lengths of all the ducts 23 can be arranged to be approximately equal. Thus the pressure waves of sounds emitted from different points on the diaphragm 12 of the speaker element 11 arrive at the outlet apertures 25 of the plane wave channel 20 almost at the same time, and as a result of this, a plane pressure wave front is created on the outer surface of the plane wave channel 20.

With this solution, the length M of the horn portion 30 can also be very small. In FIG. 16, the length M of the horn portion 30 is approximately equal to the depth L of the plane wave channel 20. Thus the distance travelled by sound from the diaphragm 12 of the speaker element 11 to the outer edge of the horn portion 30 is even less than the diameter D of the diaphragm 12 of the speaker element 11.

In the embodiment shown in FIG. 16, the horn portion 30 grows slightly in the vertical direction towards to the outer edge, i.e. the height E of the outlet aperture of the horn portion 30 is somewhat greater than the height C of the outlet aperture of the plane wave channel 20.

Figure 17:
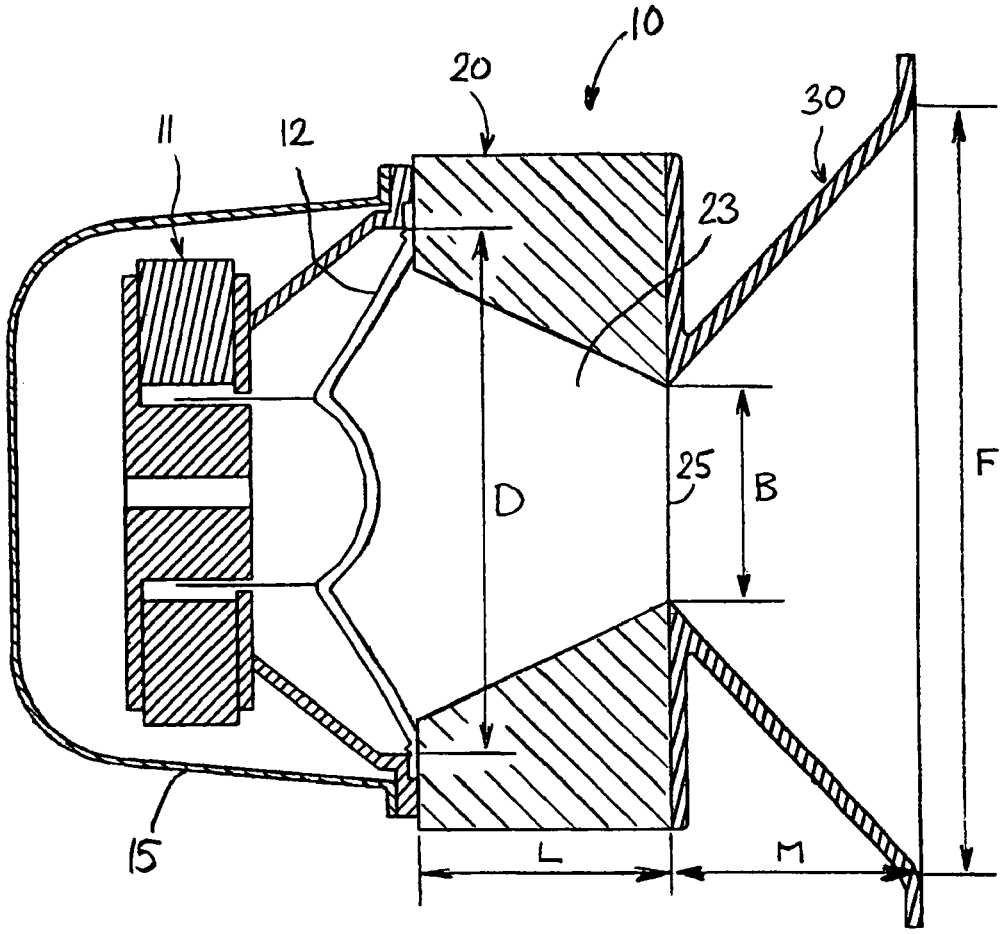

FIG. 17 represents a horizontal sectional view of the loudspeaker in FIG. 16. The figure illustrates that the width F of the horn portion 30 connected to the plane wave channel 20 is small in comparison to the horn portion of the embodiment in FIG. 10. In the embodiment shown in FIG. 17, the width F of the outlet aperture of the horn portion 30 is approximately equal to the height E of the outlet aperture of the horn portion 30 shown in FIG. 16.

LIST OF REFERENCE NUMERALS

10 loudspeaker construction
11 speaker element
12 diaphragm
15 enclosure
20 plane wave channel
21 side facing the speaker
22 side facing the horn portion
23 acoustic duct
24 inlet aperture
25 outlet aperture
26 pressure surface
30 horn portion
40 linear loudspeaker array, i.e. combination of loudspeakers
50 pressure wave front
A surface area of the diaphragm of the speaker element
A1 total surface area of the inlet apertures on the inner surface of the plane wave channel
A2 total surface area of the outlet apertures on the outer surface of the plane wave channel
B width of the outlet aperture on the outer surface transversely across the linear loudspeaker array
C height of the area formed by the outlet aperture or apertures on the outer surface of the plane wave channel in the longitudinal direction of the linear loudspeaker array, i.e. generally in the vertical direction
D diameter of the diaphragm of the speaker element
E height of the outlet aperture of the horn portion
F width of the outlet aperture of the horn portion
L depth of the plane wave channel, i.e. length of the acoustic channel leading from the diaphragm to the outer surface of the plane wave channel
M length of the horn portion, i.e. the distance from the plane wave channel to the outer edge of the horn portion

The invention claimed is:

1. A loudspeaker construction (10) comprised of a loudspeaker enclosure (15), a speaker element (11) placed in the enclosure, a loudspeaker diaphragm (12) and a horn portion (30), and in which loudspeaker construction (10) there is a compression part arranged in connection with the speaker element (11), which compression part is created by a space between the diaphragm (12) of the speaker element and, at a distance from the loudspeaker diaphragm, a solid object, characterized in that in the loudspeaker construction (10), there is a plane wave channel (20) between the speaker element (11) and the horn portion (30), in which plane wave channel there is a plurality of ducts (23) for transmitting acoustic waves through the plane wave channel so that the plane wave channel transforms the spherical pressure wave pattern of the sound waves generated by the diaphragm (12) of the speaker element into a plane wave, that in the plane wave channel (20), the surface (26) directed towards the diaphragm (12) is substantially similar in shape to the diaphragm, so that the narrow gap remaining between the plane wave channel and the diaphragm is substantially equal in size throughout the diaphragm, that on the surface (26) of the plane wave channel (20) directed towards the diaphragm (12), there are sound inlet apertures (24) for transmitting acoustic waves into the ducts (23) and, on the opposite side (22) of the plane wave channel, there are outlet apertures (25) for transmitting acoustic waves from the ducts into the horn portion (30)

that the inlet apertures (24) of the ducts (23) of the plane wave channel (20) are most preferably parallel longitudinal slits, which slits are located across the area of the diaphragm (12) of the speaker element (11) in such a way that the length of each longitudinal slit corresponds substantially to the width of the diaphragm at the location of the slit in question, and that, as viewed towards the direction of sound propagation, the dimensions of the ducts (23) of the plane wave channel (20) change so that the widths of the narrow slits of the inlet apertures (24) increase and the lengths decrease, so that adjacent outlet apertures (25) on the opposite side (22) of the wave length channel are most preferably of equal width (B).

2. A loudspeaker construction (10) as claimed in claim 1, characterized in that, in the loudspeaker construction (10), the total surface area of the inlet apertures (24) of the plane wave channel (20) is approximately one third of the surface area of the diaphragm (12) of the speaker element (11).

3. A loudspeaker construction (10) as claimed in claim 2, characterized in that two or more units of the loudspeaker construction (10) are mutually connected so that the outlet apertures (25) of adjacent plane wave channels (20) are similarly directed and of substantially equal size.

4. A loudspeaker construction (10) as claimed in claim 2, characterized in that two or more units of the loudspeaker construction (10) are mutually connected on top of or beside each other so that the outlet apertures (25) of equal width in the plane wave channels (20) located on top of or beside each other form a unified, narrow, vertically or horizontally directed row (40).

5. A loudspeaker construction (10) as claimed in claim 3, characterized in that two or more units of the loudspeaker construction (10) are mutually connected on top of or beside each other so that the outlet apertures (25) of equal width in the plane wave channels (20) located on top of or beside each other form a unified, narrow, vertically or horizontally directed row (40).

6. A loudspeaker construction (10) as claimed in claim 1, characterized in that two or more units of the loudspeaker construction (10) are mutually connected so that the outlet apertures (25) of adjacent plane wave channels (20) are similarly directed and of substantially equal size.

7. A loudspeaker construction (10) as claimed in claim 6, characterized in that two or more units of the loudspeaker construction (10) are mutually connected on top of or beside each other so that the outlet apertures (25) of equal width in the plane wave channels (20) located on top of or beside each other form a unified, narrow, vertically or horizontally directed row (40).

8. A loudspeaker construction (10) as claimed in claim 1, characterized in that two or more units of the loudspeaker construction (10) are mutually connected on top of or beside each other so that the outlet apertures (25) of equal width in the plane wave channels (20) located on top of or beside each other form a unified, narrow, vertically or horizontally directed row (40).

* * * * *